US005402808A

United States Patent [19]

Wallis et al.

[11] Patent Number: 5,402,808

[45] Date of Patent: Apr. 4, 1995

[54] PAINT ROLLER CLEANER

[76] Inventors: Scott D. Wallis; Patricia R. Wallis, both of 429 Lindbergh St., Charleston, S.C. 29412

[21] Appl. No.: 266,701

[22] Filed: Jun. 28, 1994

[51] Int. Cl.[6] ..... B08B 3/02

[52] U.S. Cl. ..... 134/104.2; 134/138; 134/157; 134/900

[58] Field of Search ..... 68/213; 134/900, 104.2, 134/199, 138, 153, 157

[56] References Cited

U.S. PATENT DOCUMENTS

| | | | |
|---|---|---|---|
| D. 267,123 | 11/1982 | Fuller . | |
| 2,725,065 | 11/1955 | Wilsing | 18/213 |
| 2,773,274 | 12/1956 | Beech | 69/213 |
| 3,428,060 | 2/1969 | Spivey . | |
| 3,886,960 | 6/1975 | Krueger . | |
| 3,897,797 | 8/1975 | Wright et al. . | |
| 4,130,124 | 12/1978 | Sherwin . | |
| 4,294,272 | 10/1981 | Klaiber . | |
| 4,311,158 | 1/1982 | Harvey . | |
| 4,641,673 | 2/1987 | Conley et al. . | |
| 4,672,987 | 6/1987 | Brandt . | |
| 4,700,728 | 10/1987 | Patterson . | |
| 4,711,258 | 12/1987 | Rossborough et al. . | |
| 4,809,722 | 3/1989 | Pennise . | |
| 4,832,066 | 5/1989 | Shipman . | |
| 5,005,598 | 4/1991 | Hodgdon . | |
| 5,095,928 | 3/1992 | Phipps . | |
| 5,163,459 | 11/1992 | Bailey . | |
| 5,238,012 | 8/1993 | Coronato . | |

FOREIGN PATENT DOCUMENTS

| | | |
|---|---|---|
| 2072001 | 9/1981 | United Kingdom . |
| 2219732 | 12/1989 | United Kingdom . |

*Primary Examiner*—Frankie L. Stinson
*Attorney, Agent, or Firm*—Richard C. Litman

[57] ABSTRACT

A paint roller cleaner includes a substantially tubular vertical housing incorporating a base for stability and a frame guide for conveniently securing a roller in vertical position within the housing. The frame guide snaps quickly onto the wire frame of the roller, and is so unobtrusive that it may be left on the roller frame during the painting process itself. In use, the frame guide seats easily within a side opening at the top open end of the housing. The frame guide is of substantially T-shaped configuration, with a circumferentially curved head and a stem. In alternative embodiments, the frame guide may be constructed so as to offer a plurality of positions for the roller when secured within the housing. The roller cleaner receives water from an outside water supply and directs the water jets against the paint roller being cleaned. The water jets make contact with the secured roller such that the rotatable mounting piece of the roller spins quickly. The mechanism results in a clean and substantially dry paint roller within thirty seconds when working under pressures of a typical municipal water supply.

13 Claims, 4 Drawing Sheets

PAINT ROLLER CLEANER

BACKGROUND OF THE INVENTION

1. Field of the Invention

The present invention relates to a device for conveniently cleaning paint from a paint roller cover while the cover is still on the roller frame.

2. Description of the Prior Art

A paint roller is a convenient tool to use, but often a messy and time-consuming one to clean. Washing all the paint out of the roller cover underneath a water tap, the most basic technique, is inefficient. It requires a large quantity of water and vigorous rubbing, and is likely to result in paint sprays, a stubborn residual layer of paint, and a wet roller that is difficult to get dry. Accordingly, numerous inventions have been created to streamline the cleaning process. Many inventions take advantage of the structure of the typical roller, which includes a grippable handle on a rigid frame, with the rigid frame having various bends and ending in a rotatable mounting piece. In use, the rotatable mounting piece is fitted with a fabric cover, of some nappiness and often having a cardboard core.

The rotatable mounting piece lends itself to the use of jets of cleaning fluid in an enclosed housing. If configured correctly, the jets can cause the mounting piece to rotate swiftly, with the impact of the water (or other cleaning fluid) removing the majority of the paint. Although an improvement on the basic tap method, many of the devices incorporating such jets do have various drawbacks. One problem is a lack of versatility, as for instance in the ability to vary the distance between the jets and a roller being cleaned. Certainly versatility in this and similar areas is to be desired, particularly if it can be achieved without a noticeable increase in cost.

Another problem with current devices is that the mechanism for securing the roller for cleaning is often awkward and time-consuming to use. Some devices use a spindle mechanism, on one or both ends of the roller to be cleaned. This arrangement often requires careful and delicate positioning. Other devices may use a combination of adjustable clamps, notches, slots, and braces, with the adjustment of the clamps obviously entailing another period of time, and possibly a period of frustration if perfect adjustment does not quickly result. Still other devices may dispense with clamps, and use notches, slots, and braces only. Two known devices use detachable locating members for locating a roller: one has resilient internal fingers, while the other uses a bracket with screw fasteners. However, it is desirable and not previously seen to have a paint roller cleaner, outfitted to accept a flow of fluid, which includes a frame guide separate from a main housing, with the frame guide clipping securely but detachably to a roller frame and making it easy to quickly and reliably secure the roller in a proper position within the main housing. It is moreover desirable to have the frame guide configured for versatility and inexpensive manufacture, such that one or more frame guides may be provided allowing for one or more of the following variations, such as the size of the roller, roller nap thickness, roller frame wire size and/or configuration, and desired location of the roller within the housing.

Numerous patents have issued for devices that clean roller covers. Warn Bailey U.S. Pat. No. 5,163,4559, issued on Nov. 17, 1992, discloses an apparatus for cleaning roller covers that involves detaching a cover from its roller. Because the cover is disengaged from the rotatable mounting piece, the general mechanism described above is not applicable. Instead, the apparatus uses turbulent fluid flow within a small enclosed space to clean the cover.

Paint roller cleaner devices that do use fluid jets to rotate the rotatable mounting piece of a roller, and thus spray clean the attached roller cover, are numerous. Devices of this type that incorporate spindle mechanisms to secure a roller are described in Donald K. Spivey U.S. Pat. No. 3,428,060, issued on Feb. 18, 1969; Raymond H. Sherwin U.S. Pat. No. 4,130,124, issued on Dec. 19, 1978; William C. Klaiber U.S. Pat. No. 4,294,272, issued on Oct. 13, 1981; Jerry J. Harvey U.S. Pat. No. 4,311,158, issued on Jan. 19, 1982; Mario C. Coronato U.S. Pat. No. 5,238,012, issued on Aug. 24, 1993; United Kingdom Patent Application No. 2,072,001A, published on behalf of Gerhard Forstar et al. on Sep. 30, 1981; and United Kingdom Patent Application No. 2,219,732A, published on behalf of William Pennington on Dec. 2, 1989.

Some patents have issued for roller cleaner devices that use extended horizontal holding trays to help secure a paint roller. Among these are David O. Shipman U.S Pat. No. 4,832,066, issued on May 23, 1989; Ronald E. Hodgdon U.S. Pat. No. 5,00,598, issued on Apr. 9, 1991; and Walter T. Fuller U.S. Pat. No. Des. 267,123, issued on Nov. 30, 1982.

Other patents have issued to roller cleaner devices in which notches, slots, and braces or the like are used in conjunction with adjustable clamps in order to secure a roller. John M. Conley et al. U.S. Pat. No. 4,641,673, issued on Feb. 10, 1987, and Charles E. Patterson U.S. Pat. No. 4,700,728, issued on Oct. 20, 1987, both demonstrate devices of this type.

Notches, slots, and braces are used, without adjustable clamps, to secure paint rollers within roller cleaning apparatuses in a number of patents. Among such patents are Ralph A. Krueger U.S. Pat. No. 3,886,960, issued on Jun. 3, 1975; LLoyd W. Brandt U.S. Pat. No. 4,672,987, issued on Jun. 16, 1987; Paul A. Pennise U.S. Pat. No. 4,809,722, issued on Mar. 7, 1989; and William A. Phipps U.S. Pat. No. 5,095,928, issued on Mar. 17, 1992.

Two patents disclose devices for cleaning paint rollers that include detachable locating members for use in securing a roller. Richard F. Rossborough et al. U.S. Pat. No. 4,711,28, issued on Dec. 8, 1987, discloses an apparatus in which the locating member grips the roller frame by means of a series of internal resilient fingers. The shape, placement, and proportions of the locating member are, however, such that it would be ungainly to retain on the roller frame during the painting process.

Orrin Marshall Wright et al. U.S. Pat. No. 3,897,797, issued on Aug. 5, 1975, discloses a device that includes a bracket which, tightened with fastening means such as screw fasteners, fits around part of the frame of a roller. It is disclosed that the bracket may be kept on a particular roller while painting, eliminating the necessity of serially removing and replacing it. However, when removing or replacing is undertaken, use of a time-consuming fastener such as a screw fastener is necessary, since the bracket involves two plates clasped around the roller frame. Furthermore, although it is noted in the patent that the bracket "is designed of a shape and placed at a location on the [paint roller] applicator as to not interfere with normal use," the bracket does jut out noticeably from the roller. Moreover, in the primary embodiment, the bracket must be used in conjunction with a separate piece, a lid, which must be placed in exact position to function.

None of the above inventions and patents, taken either singly or in combination, is seen to describe the instant invention as claimed.

SUMMARY OF THE INVENTION

The present invention concerns an improved paint roller cleaner, for use with a typical commercially available roller. The cleaner includes a substantially tubular vertical housing that is open at both ends, and the bottom end extends below the base to prevent fluids from escaping laterally. In use, the roller frame is secured vertically within the housing by a detachably attached frame guide. The cleaning action of the device comes from a plurality of offset water stream apertures that run the length of an upright water tub. The water tube sits tightly within a substantially cylindrical vertical protuberance that is integral within the housing.

Water is fed into the cleaner through a hose, and is projected at high pressure from the water stream apertures onto the roller. At sufficient pressure, the rotatable mounting piece of the roller begins spinning quickly, and wet paint or detritus on the roller cover is removed due to centrifugal force.

The waste water exits at the open bottom of the housing, and may be allowed to empty into a sink drain. Alternatively, a bucket and special bucket lid are provided. The bucket lid is configured with a central circular aperture and circumferential leg slots, so that legs of a circumferential flange of the housing may be received within the lid. Water then empties into the bucket through the central circular aperture of the bucket lid.

The shape of the frame guide is such that it snaps firmly onto the roller frame proximate to the roller cover, and is then seated in a side opening at the top end of the housing. In an alternative embodiment, the frame guide is augmented such that the position of the roller within the housing may be varied.

The frame guide is of substantially T-shaped configuration. The configuration includes a circumferentially curved head area and a straight stem area. The straight stem area has a central longitudinal groove running most of its length. At the end of the groove is a sloping area connecting to a vertical cylindrical aperture. Beyond the cylindrical aperture, at the end of the straight stem area, are two opposed gripping members that project slightly inward. In use, the longitudinal groove, the cylindrical aperture, and the opposed gripping members snap onto the roller frame close to the roller cover.

This arrangement yields a secure fit between the roller frame and the frame guide. Further, because the frame guide is small and not cumbersome, it may be retained on the roller frame during painting without interfering with the painting process. Alternatively, because the guide is so easy to remove, entailing no messing about with screws or like fasteners, it may be taken off quickly without any trouble.

The frame guide attaches to the side opening in the housing of the cleaner by way of the guide's circumferentially curved head area. The head area has at least one curved groove area to provide the means of seating the guide within the side opening. Each curved groove area includes two vertical circumferential walls and, formed within the walls, a lower recessed portion and two side recessed portions. The recessed portions slidably engage with the walls of the side opening to bring the top of the frame guide flush with the top of the housing. This configuration gives a secure fit for the roller frame, and hold the roller frame in position for consistent proper alignment with the fluid stream without any operator adjustment or manipulation during use of the cleaner. The frame guide may be manufactured with additional walls and recessed portions in order to give versatility to the positioning of the roller.

Accordingly, it is a principal object of the invention to provide a paint roller cleaner that quickly and conveniently, with no splashing of fluids, removes wet paint/debris from a roller while attached to the roller frame, and leaves the roller substantially dry.

It is an object of the invention to provide for the cleaning of paint from rollers that requires no operator handling or manipulation of the frame in order to properly position the roller cover consistently and stably in the fluid stream during the cleaning process.

It is a further object of the invention to provide a paint roller cleaner that, used regularly, vastly increases the life span of a roller and allows the recycling of paint rollers.

It is another object of the invention to provide a paint roller cleaner that includes a convenient, clippable frame guide for securely attaching a paint roller within the cleaner.

It is yet another object of the invention to provide a frame guide that can be left in an inconspicuous and non-interfering position on a roller frame while the roller is being used for painting.

It is an object of the invention to provide a frame guide whose shape can easily be conformed to a variety of paint roller frame designs so the paint roller cleaner does not become obsolete due to roller frame design changes and also offers variability in the positioning of a roller within the cleaner.

It is another object of the invention to provide a paint roller cleaner that cleans and dries so well that a cleaned roller can immediately be stored or be reused in paint of any color.

It is yet another object of the invention to substantially reduce the amount of cleaning time from the standard three to four minutes to less than thirty seconds cleaning time.

It is a further object of the invention to provide a paint roller cleaner that does not soak the core of a roller cover, so that the core, if cardboard, does not deteriorate.

It is also an object of the invention to provide a paint roller cleaner that quickly removes detritus such as sand and dirt from a roller.

It is an object of the invention to provide a paint roller cleaner that removes loosened fibers of nap and fluffs up matted nap for better painting ability.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
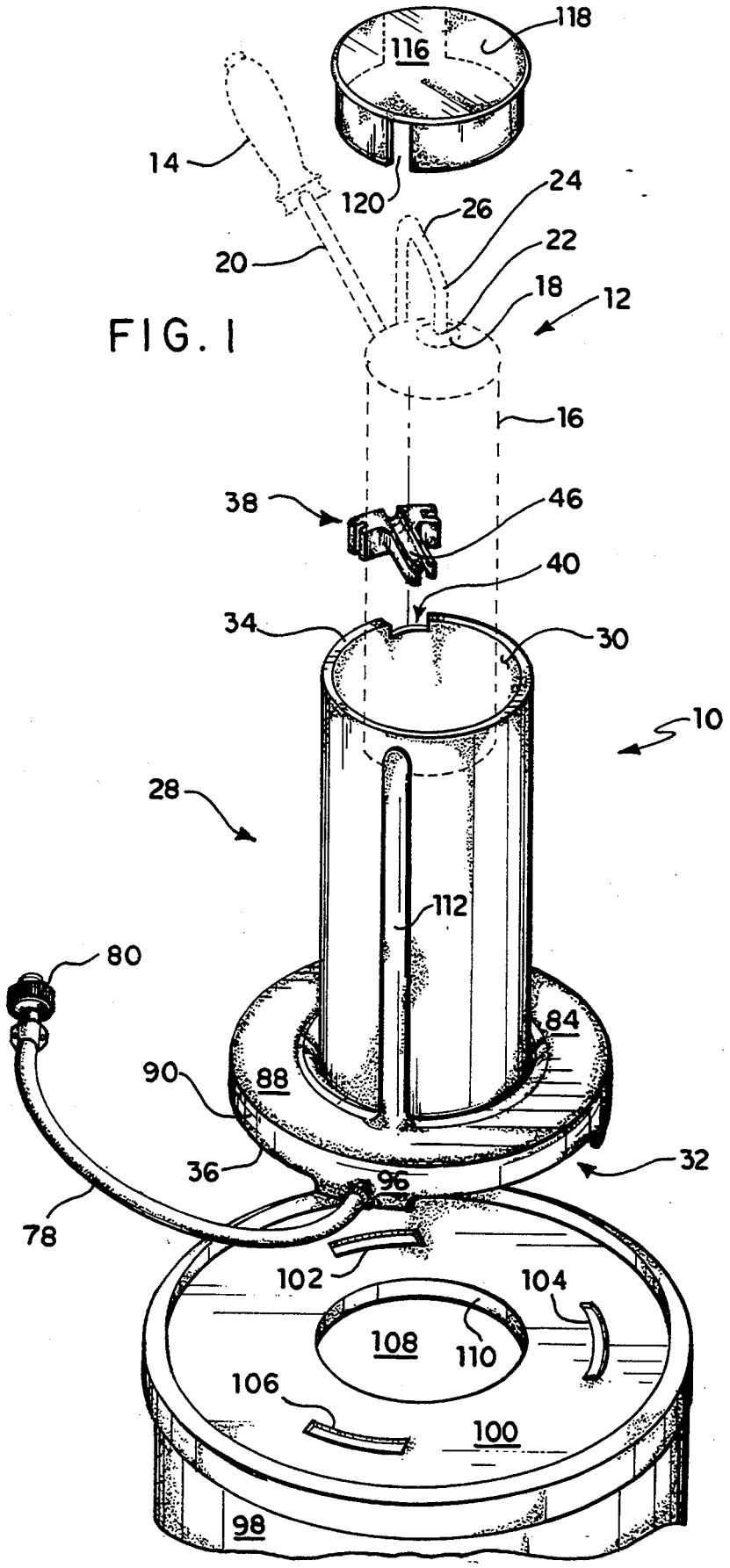
FIG. 1 is an exploded, perspective view of a paint roller cleaner according to the present invention.

Referring now to FIG. 1, the present invention is a paint roller cleaner, generally designated 10, which is particularly adapted to use in cleaning typical commercially available paint rollers. Such a paint roller 12, shown in broken lines in FIG. 2, generally includes a grippable handle 14, a roller cover 16, a rotatable mounting piece 18, and a wire roller frame 20. The wire frame 20 extends through or from the grippable handle 14, and undergoes various bends before ending in a straight arm 22 underlying the rotatable mounting piece 18 and the roller cover 16. Proximate to the rotatable mounting piece 18 is a perpendicular elbow 24, which has a second arm 26 extending from it.

In the primary embodiment, the cleaner 10 includes a substantially tubular vertical housing 28 that is open at both an open top end 30 and an open bottom end 32. The open top end 30 has a top end rim 34. The open bottom end 32 and a bottom end rim 36 are shown explicitly in FIG. 8. In use, a roller 12 is lowered into the top end 30 such that the rotatable mounting piece 18, displaying the roller cover 16 to be cleaned, is positioned vertically. Obviously, the housing 28 is large enough in all dimensions to allow the roller cover part 16 of the roller 12 inside. In this invention, the roller 12 need be secured only at the top end 30 of the housing 28. The securement is effected by the interaction between a frame guide 38, which is clipped onto the roller frame 20, and a side opening 40 in the open top end 30 of the housing 28. The side opening 40 is particularly configured to receive and hold the frame guide 38.

Figure 2:
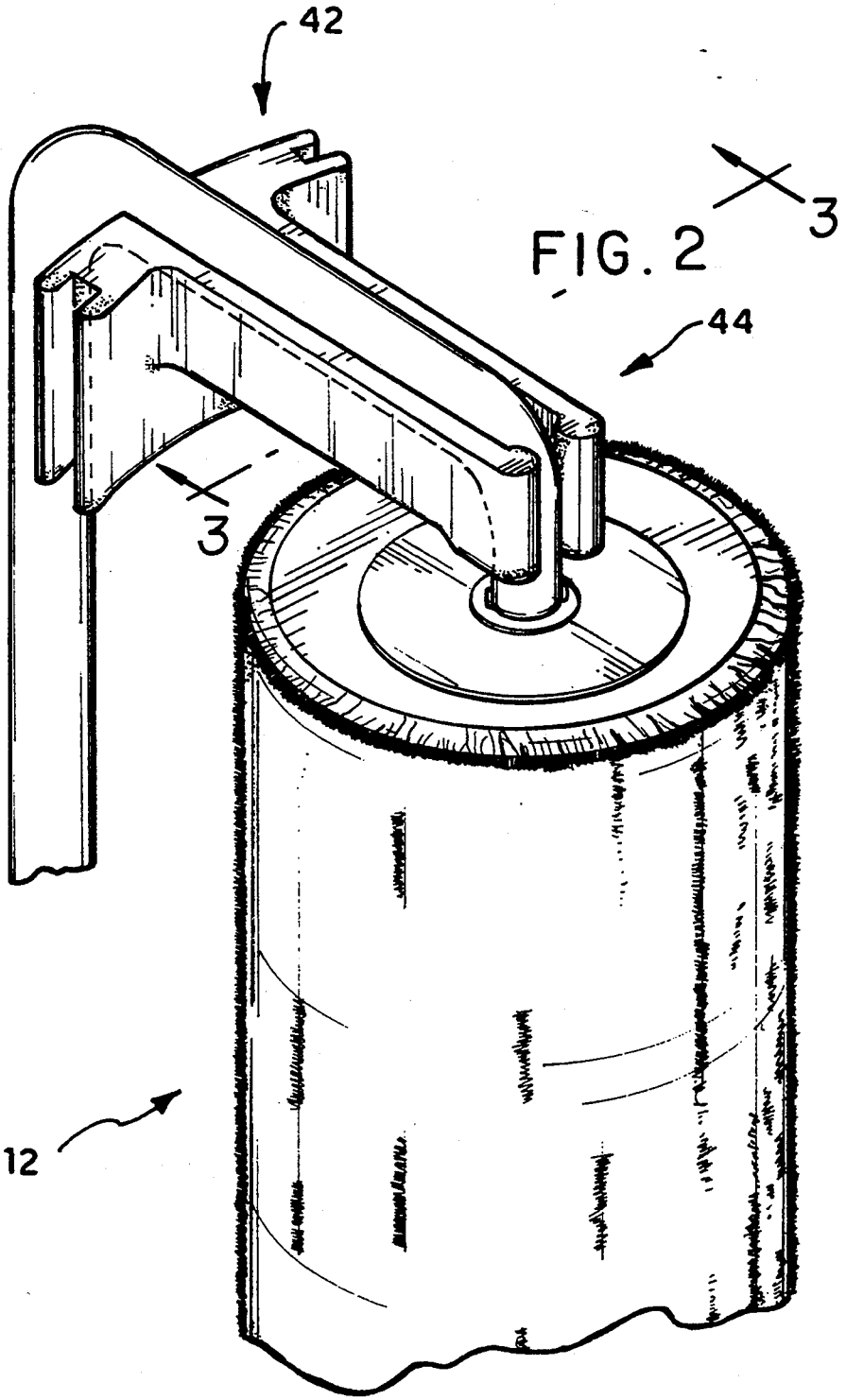
FIG. 2 is an environmental perspective view of the frame guide of the present invention.
Figure 3:
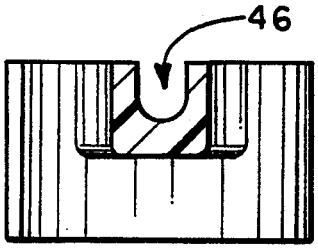
FIG. 3 is a cross-sectional detail view of the frame guide, drawn along lines 3—3 of FIG. 2.
Figure 4:
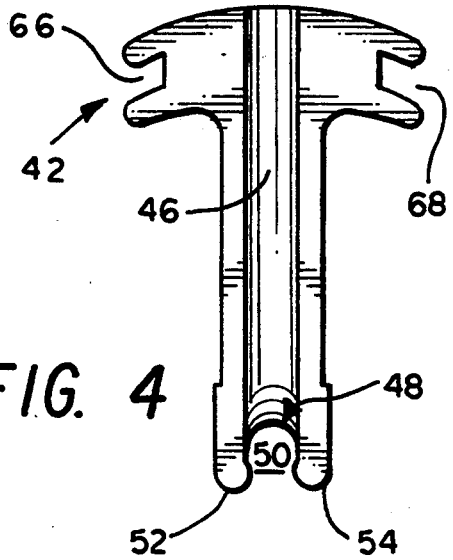
FIG. 4 is a top plan view of the frame guide.
Figure 5:
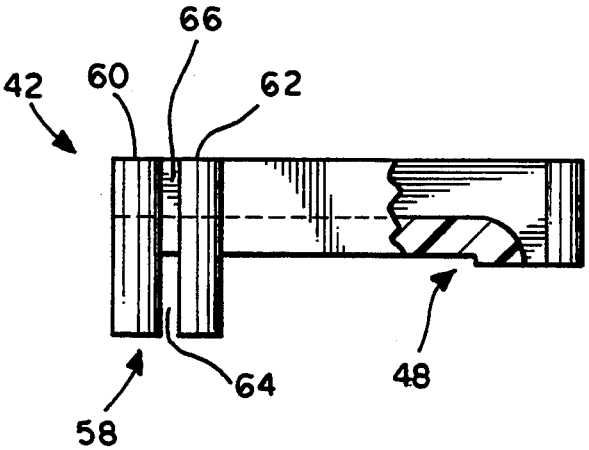
FIG. 5 is a side elevational detail view of the frame guide, partially broken away to reveal internal detail.

The frame guide 38 is of substantially T-shaped configuration, as is clearly shown in FIGS. 1–2. The frame guide 38 includes a circumferentially curved head 42 and a straight stem 44. The straight stem 44 has a central longitudinal groove 46 running most of its length. This groove 46 is shown in FIGS. 1 and 5. Referring now to FIGS. 3, 4, and 5, at the end of the groove 46 is a sloping area 48 providing gradual transition between the straight portion of groove 46 and a substantially cylindrical vertical aperture 50. Beyond the cylindrical aperture 50, at the end of the straight stem 44, are two opposed gripping members 52, 54 that project slightly inward. In use, the longitudinal groove 46 snaps along the second arm 26 of the roller 12, with the cylindrical aperture 50 and opposed gripping members 52, 54 snapping onto the elbow area 24.

This arrangement yields a strong, secure fit between the roller frame 20 and the frame guide 38. The frame guide 38 must be on the roller frame 20 while the roller cleaner 10 is in use; the frame guide 38 may also be kept on the frame 20 during painting, as the guide 38 is small and does not hinder the painting process. Alternatively, because the guide 38 is so easy to remove, merely snapping off, it may be taken off without any time-consuming procedures.

Figure 6:
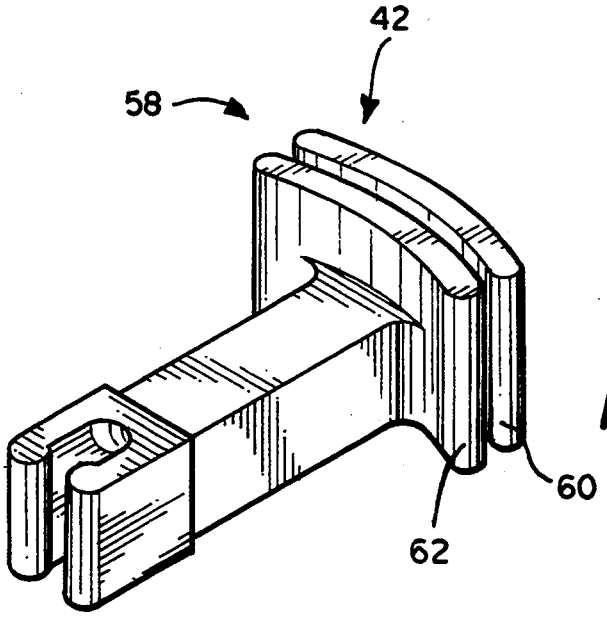
FIG. 6 is a perspective view of the frame guide.
Figure 7:
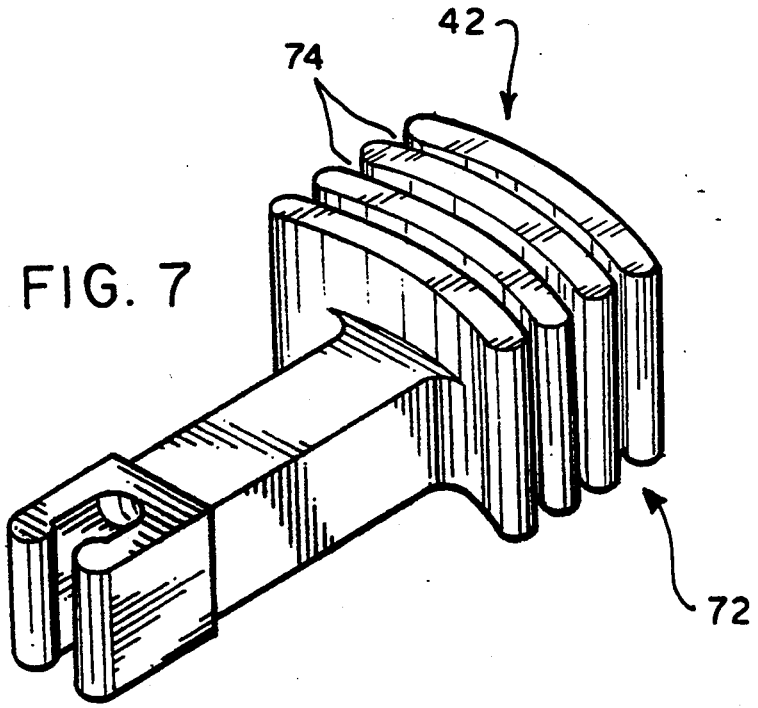
FIG. 7 is a perspective view of an alternative embodiment of the frame guide.

Once the roller frame 20 has the frame guide 38 attached to it, the step of seating the frame guide 38 within the side opening 40 may be undertaken. The frame guide 38 detachably attaches to the side opening 40 in the housing 28 of the cleaner 10 by way of the circumferentially curved head 42 of the guide 38. The head 42 has at least one curved groove area 58 to provide a mechanism for seating the guide 38 within the side opening 40. Referring particularly to FIGS. 5, 6, and 7, each curved groove area 58 includes two vertical circumferential walls 60, 62 and, formed within the walls 60, 62, a lower grooved or recessed portion 64 and two side grooved or recessed portions 66, 68. The recessed portions 64, 66, 68 slidably engage with the walls of the side opening 40 to bring the top of the frame guide 38 substantially flush with the top end rim 34 of the housing 28. This configuration gives a secure fit for the roller 12, and holds the roller frame 20 stable as the fluid stream impinges against the roller 12 during use of the cleaner 10.

In the primary embodiment, shown in FIGS. 1, 2, and 6, the simplest curved groove area arrangement is provided, there being two circumferential walls defining one groove therebetween. This first embodiment arrangement results in the roller cover 16 being held centered within the housing 28. By contrast, a frame guide 38 with additional vertical walls 72 and recessed portions 74, defining additional grooves, is shown in FIG. 7, thus providing the following versatility to the roller cleaner 10. With the inexpensive addition of these additional parts to the frame guide 38, it becomes possible to vary the positioning of the roller frame 20, and thus the roller cover 16, within the housing 28.

Figure 8:
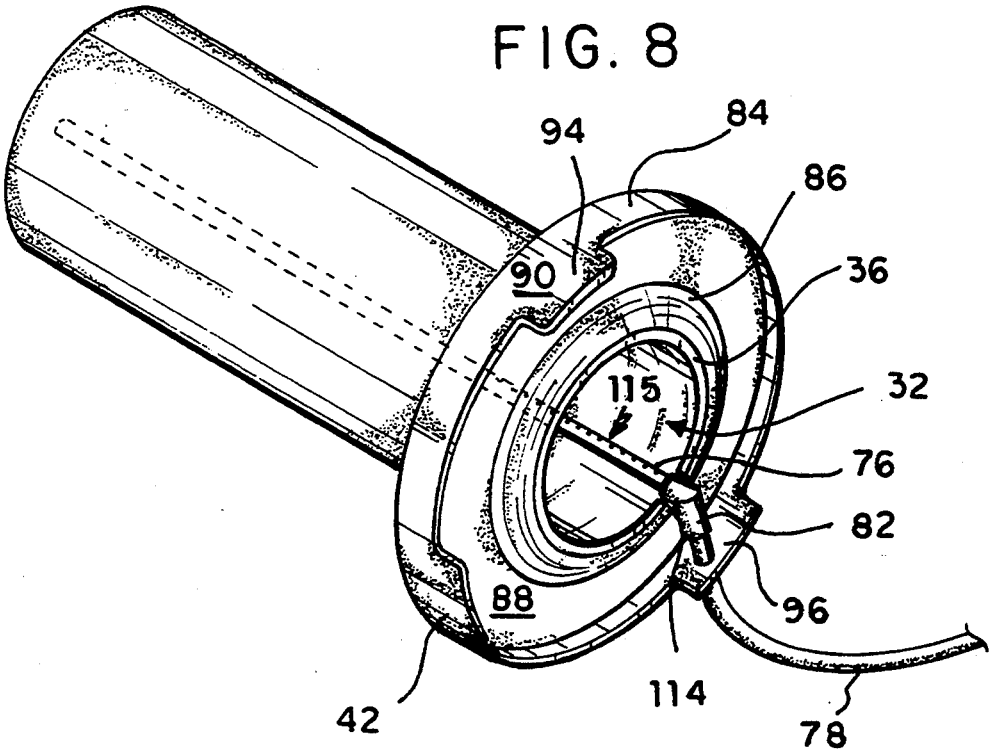
FIG. 8 is a perspective view of the housing of the present invention, shown in a tilted position.

Referring now to FIGS. 1 and 8, use of the cleaner 10 entails feeding water from a flowing water supply into an inner vertical water tube 76 or conduit in the tubular housing 28. The flowing water supply may be of any standard type, such as a sink or outdoor faucet. The water travels from the water supply through a standard hose 78, which is attached at the water supply by a standard hose connector 80 for securely retaining the hose 78 to a spigot or the like. The hose 78 is securely connected to the water tube 76 by an angled fitting, such as an elbow portion 82, at the bottom of the housing 28, to discourage kinking of hose 78.

At the bottom of the housing 28 is a circumferential flange 84. The circumferential flange 84 is integral with the open bottom end 32, specifically with the bottom end rim 36. The circumferential flange 84 includes a sloping portion 86, a horizontal portion 88, and a vertical portion 90, and gives added stability to the housing 28. The combination of the water tube and the elbow portion 82 projects down beneath the bottom end rim 36.

The vertical portion 90 of the circumferential flange 84 has at least one leg, as for instance with legs 92, 94, 96. These legs may be used to stand the housing within a sink. Alternatively, the user may wish to have any waste water empty into a bucket. This may be the case when, for instance, the user lives in an area where there are restrictions on what waste should be disposed through a waste drain. For cases such as these a bucket 98 with a specially configured bucket lid 100 is helpful. Bucket lid 100 fits securely on top of bucket 98. The bucket lid 100 has leg slots 102, 104, 106 shown in this embodiment to be three in number, and equal to the number of legs. Slots 102,104,106 are configured to securely receive the legs. The bucket lid 100 also has a circular aperture 108 at its center. The circular aperture 108 has a circumference 110 which is at least as large as the bottom end rim 36, best seen in FIG. 8. This size requirement is necessary so that any waste water empties into the bucket 98, rather than accumulating in housing 28, or escaping laterally.

Within the housing 28, water tube 76 sits within a substantially cylindrical vertical protuberance 112, which is shown in FIG. 1. The protuberance 112 is configured to securely receive water tube 76, such that the water tube 76 is held without need of additional fasteners. The water tube 76 connects with elbow portion 82 at a notch 114 in bottom end rim 36. From there, elbow portion 82 extends to and through a circular leg aperture 114 in leg 96, past which the hose 78 is connected.

Water travelling up into water tube 76, which obviously has a closed top end, exits along the length of the water tube 76 through small water stream apertures 115, which are offset so that they impinge upon the roller 12 at an angle. As is well-known in the art, the exiting water streams, when exerting sufficient pressure, will contact roller cover 16 and cause the same to rotate on rotatable mounting piece 18. This mechanism will quickly remove water-soluble wet paint from roller cover 16. A typical duration for this purpose with the present invention is from 20 to 25 seconds, when operating at water pressures typically encountered in domestic water systems.

When running at high speed in use, the cleaner 10 may generate a light spray from the open top end 30. Although the spray is minimal, a user may wish to be shielded from it. This objective may be accomplished by putting on the cleaner 10 a lid 116, which is shown in FIG. 1. The lid 116 in use sits atop the top end rim 34 and the frame guide 38, and extends inside the housing 28. The lid 116 has two apertures, a first aperture 118 and a second aperture 120. The first aperture 118 is configured to enable the lid 116 to avoid interference with the frame guide 38, while the second aperture 120 is configured to enable the lid 116 to avoid interference with the water tube 76.

The roller cleaner housing 28 and/or lid 116, which is preferably made of a sturdy plastic, may be transparent so that the cleaning process is visible. In addition to thus providing an interesting display, a transparent housing also makes it easy to tell when the cleaning process is finished. Alternatively, the housing 28 may be opaque. If opaque, the user may leave the lid 116 off in order to observe the process. Even when the housing 28 is opaque it is not difficult to determine if the cleaning process has finished, inasmuch as the sound of the lighter, cleaned roller 12 is distinctly different from that of the heavier, paint-sodden roller 12. Furthermore, the waste water exiting the base 88 will run clear when the cleaning process is completed.

The roller 12 emerges from the cleaning process not only clean, but also substantially dry. It retains so little water that it can be immediately stored away or reused.

It is to be understood that the present invention is not limited to the embodiments described above, but encompasses any and all embodiments within the scope of the following claims.

We claim:

1. A paint roller cleaner, for use with a paint roller that includes a grippable handle, a roller cover, a rotatable mounting piece, and a wire frame, with the wire frame including a first arm Underlying the rotatable mounting piece and roller cover, an elbow proximate to the rotatable mounting piece, a second arm extending from the elbow, and other arms connecting the mounting piece to the handle, comprising:

a frame guide including a circumferentially curved head and a stem of predetermined configuration, a vertical housing having an open top end and an open bottom end, said open top end having a .top end rim and said open bottom end having a bottom end rim, said housing having an inner vertical water conduit, said open top end having means defining a side opening, configured to securely receive said frame guide, said circumferentially curved head of said frame guide having at least one curved groove area, configured to seat within said side opening, each of said at least one curved groove area of said circumferentially curved head further including a lower recessed portion, two side recessed portions, and two vertical circumferential walls;

said stem of said frame guide having means defining a central longitudinal groove configured to securely receive the second arm extending from the elbow of the wire frame of the roller, and having two opposed gripping members and means defining a substantially cylindrical vertical aperture at the end of said central longitudinal groove immediately before said opposed gripping members, said opposed gripping members extending inwardly from said stem and being configured to grip strongly around the elbow area of the wire frame of the roller.

2. The paint roller cleaner according to claim 1, further including a lid, said lid configured to sit on top of said top end rim and said seated frame guide and to extend inside of said housing, said lid including means defining a first aperture and a second aperture, said first aperture provided to avoid interference with said frame guide and said second aperture provided to avoid interference with said water conduit.

3. The paint roller cleaner according to claim 1, wherein said housing further includes a substantially cylindrical vertical protuberance, said protuberance configured to securely receive said water conduit.

4. The paint roller cleaner according to claim 3, wherein said water tube includes a plurality of small water stream apertures offset from the rotational axis of the roller cover.

5. The paint roller cleaner according to claim 4, further including a circumferential flange having a sloping portion, a horizontal portion and a vertical portion, said circumferential flange integral with said open bottom end.

6. The paint roller cleaner according to claim 5, further including an elbow portion securely connected with said water conduit, the combination of said water conduit and said elbow portion projecting beneath said open bottom end.

7. The paint roller cleaner according to claim 6, further including a hose and hose attachment means, said hose connecting to said elbow portion and said hose attachment means configured to connect said hose with a flowing water supply.

8. The paint roller cleaner according to claim 7, said vertical portion of said circumferential flange further including leg means projecting downwardly therefrom, for stably supporting said paint roller cleaner.

9. The paint roller cleaner according to claim 8, further including a bucket lid, said bucket lid having means defining a circular aperture at its center, said circular aperture having a circumference, said circumference being at least as large as said bottom end rim, said bucket lid further having means defining leg slots, said leg slots being configured to securely receive said leg means.

10. The paint roller cleaner according to claim 9, further including a bucket, said bucket lid attachable securely on top of said bucket.

11. The paint roller cleaner according to claim 8, said housing being transparent.

12. The paint roller cleaner according to claim 8, said housing being opaque.

13. A paint roller cleaner, for use with a paint roller that includes a grippable handle, a roller cover, a rotatable mounting piece, and a wire frame, with the wire frame including a first arm underlying the rotatable mounting piece and roller cover, an elbow proximate to the rotatable mounting piece, a second arm extending from the elbow, and other arms connecting the mounting piece to the handle, comprising:

a frame guide including a circumferentially curved head and a stem of a predetermined configuration and having two opposed gripping members and means defining a substantially cylindrical vertical aperture at the end of said central longitudinal groove immediately before said opposed gripping members, said opposed gripping members extending inwardly from said stem and being configured to grip strongly around the elbow area of the wire frame of the roller;

a vertical housing having an open top end and an open bottom end, said open top end having a top end rim and said open bottom end having a bottom end rim, said open top end having means defining a side opening, configured to securely receive said frame guide, said housing having an inner vertical water conduit, said water conduit including means defining a plurality of water stream apertures offset from the rotational axis of the roller cover, said housing further including a substantially cylindrical vertical protuberance configured to securely receive said water conduit, said housing further including a circumferential flange having a sloping portion, a horizontal portion and a vertical portion, said circumferential flange integral with said open bottom end, said vertical portion of said circumferential flange further including a plurality of legs projecting downwardly therefrom, for stably supporting said paint roller cleaner and allowing fluids to freely escape the roller cleaner housing;

said paint roller cleaner including a fitting for securely connecting a hose to said water conduit, the combination of said water conduit and said fitting projecting beneath said open bottom end;

a lid configured to sit on top of said top end rim and said seated frame guide and to extend inside of said housing, said lid including means defining a first aperture and a second aperture, said first aperture provided to avoid interference with said frame guide and said second aperture provided to avoid interference with said water conduit; and a bucket and a bucket lid, said bucket lid attachable securely on top of said bucket, and said bucket lid having means defining a circular aperture at its center, said circular aperture having a circumference, said circumference being at least as large as said bottom end rim, said bucket lid further having means defining leg slots, said leg slots being configured to securely receive said legs;

said circumferentially curved head of said frame guide having at least one curved groove area, configured to seat within said side opening, each of said at least one curved groove area of said circumferentially curved head further including a lower recessed portion, two side recessed portions, and two vertical circumferential walls;

said stem of said frame guide having means defining a central longitudinal groove configured to securely receive the second arm extending from the elbow of the wire frame of the roller.

* * * * *